United States Patent [19]

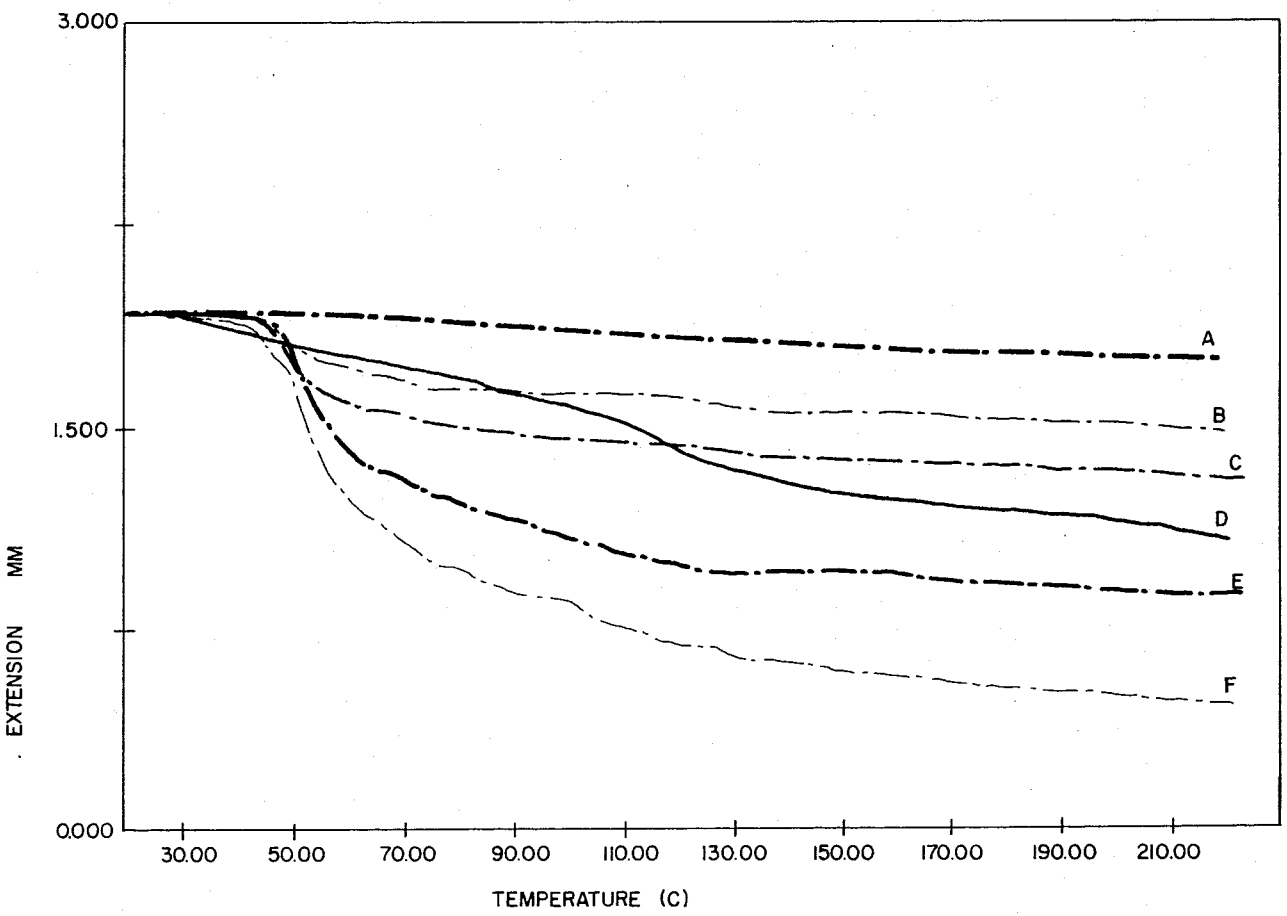
A
B
C
D
E
F
3.000
1.500
0.000
EXTENSION MM
30.00
50.00
70.00
90.00
110.00
130.00
150.00
170.00
190.00
210.00
TEMPERATURE (C)

Pangrazi et al.

[11] Patent Number: 4,859,508

[45] Date of Patent: Aug. 22, 1989

[54] HEAT RESISTANT BINDERS

[75] Inventors: Ronald Pangrazi, Somerville; James L. Walker, Whitehouse Station, both of N.J.

[73] Assignee: National Starch and Chemical Corporation, Bridgewater, N.J.

[21] Appl. No.: 912,747

[22] Filed: Sep. 26, 1986

[51] Int. Cl.[4] ..... B05D 3/02

[52] U.S. Cl. ..... 427/389.9; 55/524; 210/506; 427/392; 428/288; 428/290; 428/500; 428/510; 428/920

[58] Field of Search ..... 427/389.9, 392

[56] References Cited

U.S. PATENT DOCUMENTS

| | | | |
|---|---|---|---|
| 3,241,994 | 10/1962 | Madaras et al. . | |
| 3,967,032 | 6/1976 | Plotz et al. | 428/300 |
| 4,413,073 | 11/1983 | Gibson et al. | 523/511 |
| 4,539,254 | 9/1985 | O'Connor et al. | 428/236 |
| 4,599,258 | 7/1986 | Hageman | 428/140 |

OTHER PUBLICATIONS

"Method of Evaluating Heat Resistance of Polymers Through Thermomechanical Analysis", M. E. Yannich and R. Pangrazi; 1986 TAPPI Proceedings; 1986 Nonwovens Conference.

*Primary Examiner*—James C. Cannon
*Attorney, Agent, or Firm*—Ellen T. Dec; Edwin M. Szala

[57] ABSTRACT

Heat resistant binders for flexible nonwoven mats may be prepared using an emulsion polymer comprising 100 parts by weight of acrylate or styrene/acrylate monomers, 3 to 6 parts of a blocked, N-methylol containing comonomer, 0 to 3 parts of a water soluble non-blocked N-methylol containing comonomer and 0 to 5 parts of a multifunctional comonomer. The use of the blocked N-methylol containing comonomer permits the incorporation into the latex binders of higher levels of N-methylol functionality with consequent increase in heat resistance. As such, the binders are useful in the formation of heat resistant flexible mats for use in roofing, flooring and filtering materials.

13 Claims, 1 Drawing Sheet

HEAT RESISTANT BINDERS

BACKGROUND OF THE INVENTION

The present invention is directed to binders for use in the formation of nonwoven mats to be utilized in areas where heat resistance is important. Such mats find use in a variety of applications including as components in roofing, flooring and filtering materials.

Specifically, in the formation of asphalt-like roofing membranes such as those used on flat roofs, polyester mats about 1 meter in width are formed, saturated with binder, dried and cured to provide dimensional stability and integrity to the mats allowing them to be rolled and transported to a converting operation where one or both sides of the mats are coated with molten asphalt. The binder utilized in these mats plays a number of important roles in this regard. If the binder composition does not have adequate heat resistance, the polyester mat will shrink when coated at temperatures of 170°-50° C. with the asphalt. A heat resistant binder is also needed for application of the roofing when molten asphalt is again used to form the seams and, later, to prevent the roofing from shrinking when exposed to elevated temperatures over extended periods of time. Such shrinking would result in gaps or exposed areas at the seams where the roofing sheets are joined as well as at the perimeter of the roof.

Since the binders used in these structures are present in substantial amounts, i.e., on the order of about 25% by weight, the physical properties thereof must be taken into account when formulating for improved heat resistance. Thus, the binder must be stiff enough to withstand the elevated temperatures but must also be flexible at room temperature so that the mat may be rolled or wound without cracking or creating other weaknesses which could lead to leaks during and after impregnation with asphalt.

Binders for use on nonwoven mats have conventionally been prepared from acrylate or styrene/acrylate copolymers. In order to improve the heat resistance thereof, crosslinking functionalities including N-methylol containing comonomers, have been incorporated into these copolymers; however, the addition of more than about 3% by weight of the N-methylol component is difficult to achieve due to thickening of the latex, particularly those latices containing styrene, at the 45 to 60% solids level most commonly used.

Other techniques for the production of heat resistant roofing materials include that described in U.S. Pat. No. 4,539,254 involving the lamination of a fiberglass scrim to a polyester mat thereby combining the flexibility of the polyester with the heat resistance of the fiberglass.

SUMMARY OF THE INVENTION

Heat resistant binders for flexible polyester mats may be prepared using an emulsion polymer having a glass transition temperature (Tg) of +10 to +50° C.; the polymer comprising 100 parts by weight of acrylate or styrene/acrylate monomers, 3 to 6 parts of a blocked, N-methylol containing comonomer selected from the group consisting of N-(iso-butoxymethyl)acrylamide, N-(iso-propoxymethyl)acrylamide and N-(propoxymethyl)acrylamide; 0 to 3 parts of a water soluble non-blocked N-methylol containing comonomer and 0 to 3 parts of a multifunctional comonomer.

The use of the blocked N-methylol containing comonomer permits the incorporation into the latex binders of higher levels of N-methylol functionality with consequent increase in heat resistance. Moreover, since the blocked N-methylol comonomer enters into the monomer phase of the emulsion polymerization reaction, greater heat resistance is obtained than would be achieved if an attempt were made to polymerize comparable levels of the unblocked water-soluble N-methylol functionality into the binder. As such, the binders are useful in the formation of heat resistant flexible mats for use in roofing, flooring and filtering materials.

BRIEF DESCRIPTION OF THE DRAWING

The single FIGURE is a graph illustrating the dimensional changes as a function of temperature for a series of binders.

DETAILED DESCRIPTION OF THE PREFERRED EMBODIMENTS

The acrylate or styrene/acrylate monomers comprise the major portion of the emulsion copolymer and should be selected to have a Tg within the range of +10° to +50° C., preferably about 25° to 45° C. The acrylates used in the copolymers described herein the alkyl acrylates containing 1 to 4 carbon atoms in the alkyl group including methyl, ethyl, propyl and butyl acrylate. The corresponding methacrylates may also be used as may mixtures of any of the above. Suitable copolymers within this Tg range may be prepared, for example, from copolymers of styrene with $C_2$–$C_4$ acrylates or methacrylate and from copolymers of $C_{2-C4}$ acrylates or methacrylate with methyl methacrylate or other higher Tg methacrylates. The relative proportions of the comonomers will vary depending upon the specific acrylate(s) employed. Thus relatively soft, low Tg acrylates are used in lesser amounts to soften the harder styrene comonomer or stiff methacrylate comonomer while larger amounts of the harder, higher Tg acrylates are required to achieve the same Tg range. Due to the problems inherent in providing high levels of N-methylol functionality into styrene/$C_{2-C4}$ acrylate copolymers, these polymers are particularly adapted for use in the binders disclosed herein.

The blocked N-methylol containing comonomers used herein include N-(iso-butoxymethyl) acrylamide which is most readily available commercially and therefore preferred, N-(iso-propoxymethyl) acrylamide and N-(propoxymethyl) acrylamide. The blocked N-methylol component is utilized in amounts of 3 to 6 parts by weight per 100 parts of the acrylate or styrene/acrylate monomers. Amounts in excess of about 6 parts may be used but no advantage is seen therein.

Optionally, there may also be present an unblocked N-methylol containing comonomer. This component is generally N-methylol acrylamide although other monoolefinically unsaturated compounds containing an N-methylol group and capable of copolymerizing with the styrene acrylate copolymer may also be employed. Such other compounds include, for example, N-methylol methacrylamide, or lower alkanol ethers thereof or mixtures thereof. The amount of the unblocked N-methylol containing comonomer used may vary from about 0.5 to about 3 parts by weight per 100 parts acrylate or styrene/acrylate monomers with the maximum amount employed being dependent upon the processing viscosity of the latex at the particular solids level.

In order to achieve optimum heat resistance in the binder composition the relative amounts of the two N-methylol containing functionalities must be considered. Thus, if no unblocked N-methylol comonomer is used, higher amounts of the blocked comonomer are preferred while lower levels may be used if unblocked N-methylol comonomers are also present. In general, the combined amounts of the N-methylol containing comonomers in the preferred binders will total about 5 to 6 parts per 100 parts acrylate or styrene/acrylate monomer.

Additionally, there may be present in the binders of the invention 0.1 to 3 parts by weight, preferably 0.5 to 1.5 parts, of a multifunctional comonomer. These multifunctional monomers provide some crosslinking and consequent heat resistance to the binder prior to the ultimate heat activated curing mechanism. Suitable multifunctional monomers include vinyl crotonate, allyl acrylate, allyl methacrylate, diallyl maleate, divinyl adipate, diallyl adipate, divinyl benzene, diallyl phthalate, ethylene glycol diacrylate, ethylene glycol dimethacrylate, butanediol dimethacrylate, methylene bisacrylamide, triallyl cyanurate, trimethylolpropane triacrylate, etc.

Olefinically unsaturated acids may also be employed to improve adhesion to the polyester web and contribute some additional heat resistance. These acids include the alkenoic acids having from 3 to 6 carbon atoms, such as acrylic acid, methacrylic acid, crotonic acid; alkenedioic acids, e.g., itaconic acid, maleic acid or fumaric acid or mixtures thereof in amounts sufficient to provide up to about 4 parts by weight of monomer units per 100 parts of the acrylate or styrene/acrylate monomers.

These binders are prepared using conventional emulsion polymerization procedures. In general, the respective comonomers are interpolymerized in an aqueous medium in the presence of a catalyst, and an emulsion stabilizing amount of an anionic or a nonionic surfactant or mixtures thereof, the aqueous system being maintained by a suitable buffering agent, if necessary, at a pH of 2 to 6. The polymerization is performed at conventional temperatures from about 20° to 90° C., preferably from 50° to 80° C., for sufficient time to achieve a low monomer content, e.g. from 1 to about 8 hours, preferably from 3 to about 7 hours, to produce a latex having less than 1.5 percent preferably less than 0.5 weight percent free monomer. Conventional batch, semi-continuous or continuous polymerization procedures may be employed.

The polymerization is initiated by a water soluble free radical initiator such as water soluble peracid or salt thereof, e.g. hydrogen peroxide, sodium peroxide, lithium peroxide, peracetic acid, persulfuric acid or the ammonium and alkali metal salts thereof, e.g. ammonium persulfate, sodium peracetate, lithium persulfate, potassium persulfate, sodium persulfate, etc. A suitable concentration of the initiator is from 0.05 to 3.0 weight percent and preferably from 0.1 to 1 weight percent.

The free radical initiator can be used alone and thermally decomposed to release the free radical initiating species or can be used in combination with a suitable reducing agent in a redox couple. The reducing agent is typically an oxidizable sulfur compound such as an alkali metal metabisulfite and pyrosulfite, e.g. sodium metabisulfite, sodium formaldehyde sulfoxylate, potassium metabisulfite, sodium pyrosulfite, etc. The amount of reducing agent which can be employed throughout the copolymerization generally varies from about 0.1 to 3 weight percent of the amount of polymer.

The emulsifying agent can be of any of the nonionic or anionic in-water surface active agents or mixtures thereof generally employed in emulsion polymerization procedures. When combinations of emulsifying agents are used, it is advantageous to use a relatively hydrophobic emulsifying agent in combination with a relatively hydropholic agent. The amount of emulsifying agent is generally from about 1 to about 10, preferably from about 2 to about 6, weight percent of the monomers used in the polymerization.

The emulsifier used in the polymerization can also be added, in its entirety, to the initial charge to the polymerization zone or a portion of the emulsifier, e.g. from 90 to 25 percent thereof, can be added continuously or intermittently during polymerization.

The preferred interpolymerization procedure is a modified batch process wherein the major amounts of some or all the comonomers and emulsifier are added to the reaction vessel after polymerization has been initiated. In this matter, control over the copolymerization of monomers having widely varied degrees of reactivity can be achieved. It is preferred to add a small portion of the monomers initially and then add the remainder of the major monomers and other comonomers intermittently or continuously over the polymerization period which can be from 0.5 to about 10 hours, preferably from about 2 to about 6 hours.

The latices are produced and used at relatively high solids contents, e.g. up to about 60%, although they may be diluted with water if desired. The preferred latices will contain about from 45 to 55, and, most preferred about 50% weight percent solids.

In utilizing the binders of the present invention, the polyester fibers are collected as a mat using spun bonded, needle punched or entangled fiber techniques. When used for roofing membranes, the resultant mat preferably ranges in weight from 30 grams to 300 grams per square meter with 30 to 100 grams being more preferred and 50 to 75 considered optimal. The mat is then soaked in an excess of binder emulsion to insure complete coating of fibers with the excess binder removed under vacuum or pressure of nip/print roll. The polyester mat is then dried and the binder composition cured preferably in an oven at elevated temperatures of at least about 150° C. Alternatively, catalytic curing may be used, such as with an acid catalyst, including mineral acids such as hydrochloric acid; organic acids such as oxalic acid or acid salts such as ammonium chloride, as known in the art. The amount of catalyst is generally about 0.5 to 2 parts by weight per 100 parts of the acrylate or styrene/acrylate copolymer.

Other additives commonly used in the production of binders for these nonwoven mats may optionally be used herein. Such additives include ionic crosslinking agents, thermosetting resins, thickeners, flame retardants and the like.

While the discussion above has been primarily directed to polyester mats for use as roofing membranes, the binders of the invention are equally applicable in the production of other nonwoven mats including polyester, felt or rayon mats to be used as a backing for vinyl flooring where the vinyl is applied at high temperatures and under pressure so that some heat resistance in the binder is required. Similarly, cellulosic wood pulp filters for filtering hot liquids and gases require heat resistant binders such as are disclosed herein.

The following examples are given to illustrate the present invention, but it will be understood that they are intended to be illustrative only and not limitative of the invention. In the examples, all parts are by weight and all temperatures in degrees Celsius unless otherwise noted.

EXAMPLE I

The following example describes a method for the preparation of the latex binders of the present invention.

To a 5 liter stainless steel reaction vessel was charged: 1000 g water, 2.5 g Aerosol A102 a surfactant from American Cyanamid, 60 g Triton X-405 a surfactant from Rohm & Haas, 0.8 g sodium acetate, and 1.75 g ammonium persulfate.

After closing the reactor, the charge was purged with nitrogen and evacuated to a vacuum of 25–37 inches mercury. Then 65 g of ethyl acrylate monomer was added.

The reaction was heated to 65° to 79° C. and after polymerization started, the remainder of the monomer and functional comonomer was added. An emulsified monomer mix consisting of 225 g water, 100 g of AER A102, 52.5 g of 48% aqueous solution of N-methylol acrylamide, 60 g of N-(isobutoxymethyl) acrylamide, 25 g methacrylic acid, 10.0 g trimethylol propane triacrylate, 685 g ethyl acrylate and 500 g styrene was prepared as was a solution of 3.0 g ammonium persulfate and 1.25 g 28% $NH_4OH$ in 125.0 g of water. The emulsified monomer mix and initiator solutions were added uniformly over four (4) hours with the reaction temperature is maintained at 75° C. At the end of the addition, the reaction was held 1 hour at 75° C., then 1.5 g of t-butyl hydroperoxide and 1.5 g sodium formaldehyde sulfoxylate in 20 g of water was added to reduce residual monomer.

The latex was then cooled and filtered. It had the following typical properties: 45.8% solids, pH 4.8, 0.18 micron average particle size and 150 cps viscosity.

The resultant binder, designated Emulsion B, had a composition of 60 parts ethyl acrylate, 40 parts styrene, 2 parts N-methylolacrylamide, 4.0 parts N-(iso-butoxymethyl) acrylamide, 2 parts methacrylic acid and 0.8 part trimethylolpropane triacrylate (60 EA/40 ST NMA/4 i-BMA/2 MAA/0.8 TMPTA) as a base.

Using a similar procedure the following emulsions were prepared using 100 parts of a 60/40 ethyl acrylate/styrene monomers.

Emulsion A: 3 NMA/3 i-BMA/2 MAA/1 TMPTA
Emulsion B: 2 NMA/4 i-BMA/2 MAA/0.8 TMPTA
Emulsion C: 2 NMA/3 i-BMA/2 MAA/1 TMPTA
Control E : 2 NMA/2.5 i-BMA/2 MAA/0.5 TMPTA
Control F*: 2 NMA/2.5 i-BMA 2 MAA/0.5 TMPTA L6(* a copolymer of 35 ethyl acrylate, 15 ethyl acrylate and 50 styrene)

In testing the binders prepared herein, a polyester spunbonded, needle punched mat was saturated in a low solids (10–30%) emulsion bath. Excess emulsion was removed by passing the saturated through nip rolls to give samples containing 25% binder on the weight of the polyester. The saturated mat was dried on a canvas covered drier then cured in a forced air oven for 10 minutes at a temperature of 150° C. Strips were then cut 2.54 cm by 12.7 cm in machine direction. Tensile values were measured on an Instron tensile tester Model 1130 equipped with an environmental chamber at crosshead speed 10 cm/min. The gauge length at the start of each test was 7.5 cm.

In order to evaluate the heat resistance of the binders prepared herein, a Thermomechanical Analyzer was employed to show a correlation between conventional tensile and elongation evaluations.

The Thermomechanical Analyzer measures dimensional changes in a sample as a function of temperature. In general, the heat resistance is measured by physical dimensional changes of a polymer film as a function of temperature which is then recorded in a chart with temperature along the abscissa and change in linear dimension as the ordinate. Higher dimensional change in the samples represents lower heat resistance. The initial inflection is interpreted as the thermo-mechanical glass transition temperature (Tg) of the polymer.

Samples were prepared for testing on the Analyzer by casting films of the binders on Teflon coated metal plates with a 20 mil. applicator.

Emulsions A-14 C, Controls E and F and a commercially available all acrylic copolymer, designated D, containing only NMA (approximately 3 parts), were tested as described above and the results presented in the accompanying figure. As the results indicate, Emulsions A, B, and C prepared in accordance with the invention and containing at least 3 parts of a blocked N-methylol comonomer exhibited heat resistance superior to that achieved utilizing a commercially available binder. In contrast, emulsions containing lower levels of the blocked comonomer did not provide adequate resistance for commercial applications. The dimensional changes in millimeters at two specific intervals, delta 100° C. and 200° C. were recorded as Δ100° and Δ200° respectively and are presented below.

| | Δ100° | Δ200° |
|---|---|---|
| Emulsion A | 0.065 | 0.173 |
| Emulsion B | 0.302 | 0.421 |
| Emulsion C | 0.464 | 0.594 |
| Acrylic Control D | 0.345 | 0.777 |
| Control E | 0.842 | 1.036 |
| Control F | 1.079 | 1.414 |

EXAMPLE II

Repeating the basic procedure of Example I, other emulsion were prepared using the following components and amounts. Also show in the table are the changes in dimension in millimeters exhibited at 100° C. and 200° C.

| Emulsion | NMA | i-BMA | MAA | TMPTA | Δ100° | Δ200° |
|---|---|---|---|---|---|---|
| G | 2 | 4.5 | 2 | 1 | 0.171 | 0.375 |
| H | 2 | 4 | 3 | 1 | 0.196 | 0.426 |
| I | 2 | 4 | 2 | 1 | 0.281 | 0.494 |
| J | 2 | 4 | 2 | 0 | 0.350 | 0.554 |
| K | 4 | 0 | 2 | 0 | 0.477 | 0.699 |
| L | 5 | 0 | 0 | 0 | 0.150 | 0.955 |

The results show that superior heat resistance as manifested by low delta values is achieved utilizing binders G, H, I and J within the scope of the invention. In contrast, Emulsion K which contains 4 parts NMA but no blocked comonomer exhibited larger delta values and hence lower heat resistance. A delta value shown for a film cast immediately after polymerization of Emulsion L containing 5 parts NMA also exhibited lower heat resistance at elevated temperatures than did the compositions of the invention. Soon after casting of the film, the Emulsion L coagulated; so that, even were the heat resistance adequate, it could not be used commercially.

EXAMPLE III

Additional samples were prepared as in Example I using various amounts of other blocked N-methylol comonomers. In the table, iPMA is N-(isopropoxymethyl) acrylamide and N PMA is N-(propoxymethyl) acrylamide.

| Emulsion | NMA | iPMA | NPMA | MAA | TMPTA | Δ100° | Δ200° |
|---|---|---|---|---|---|---|---|
| M | 2 | 4 | 0 | 2 | 1 | 0.085 | 0.324 |
| N | 2 | 2.5 | 0 | 2 | 1 | 0.051 | 0.307 |
| O | 2 | 0 | 4 | 2 | 1 | 0.375 | 0.580 |

As shown by the values in the column, heat resistant binders may be prepared using these other blocked comonomers.

EXAMPLE IV

An all acrylic copolymer was prepared according to the procedures of Example I utilizing 40 parts methyl methacrylate, 2 parts methacrylic acid, 2 parts N-methylol acrylamide and 4 parts N-(iso-butoxymethyl-)acrylamide. When tested on the Thermomechanical analyzer, film of the binder gave delta 100° and delta 200° values of 0:333 and 0.600, respectively.

It will be apparent that various changes and modifications may be made in the embodiments of the invention described above, without departing from the scope of the invention, as defined in the appended claims, and it is intended therefore, that all matter obtained in the foregoing description shall be interpreted as illustrative only and not as limitative of the invention.

We claim:

1. A process for preparing a heat resistant nonwoven mat comprising the steps of:

(a) impregnating the mat with an emulsion polymer having a glass transition temperature (Tg) of +10° to +50° C., said polymer comprising 100 parts by weight of $C_1$ to $C_4$ acrylate or styrene/$C_2$ to $C_4$ acrylate monomers, 3 to 6 parts of a blocked, N-methylol containing comonomer selected from the group consisting of N-(iso-butoxymethyl)acrylamide, N-(iso-(propoxymethyl)-acrylamide and N-(propoxymethyl)acrylamide; 0 to 3 parts of a water soluble non-blocked N-methylol containing comonomer; and 0 to 3 parts of a multifunctional comonomer:

(b) removing excess binder:

(c) drying and curing the mat.

2. The process of claim 1 wherein the mat is cured by heating at a temperature of at least about 150° C.

3. The process of claim 1 wherein the mat is cured by catalysis.

4. The process of claim 1 wherein the binder is applied in an amount of 30 to 300 grams per square meter of the polyester mat.

5. The process of claim 1 wherein the emulsion polymer contains as a major constituent monomers of styrene and a $C_{2-C4}$ acrylate.

6. The process of claim 1 wherein the blocked N-methylol containing comonomer in the emulsion polymer is N-(iso-butoxymethyl)acrylamide.

7. The process of claim 1 wherein the total of the N-methylol containing comonomers in the emulsion polymer is 5–6 parts per 100 parts of the acrylate or styrene/acrylate monomers.

8. The process of claim 1 wherein the multifunctional comonomer in the emulsion polymer is selected from the group consisting of vinyl crotonate, allyl acrylate, allyl methacrylate, diallyl maleate, divinyl adipate, diallyl adipate, divinyl benzene, diallyl phthalate, ethylene glycol diacrylate, ethylene glycol dimethacrylate, butanediol dimethacrylate, methylene bis-acrylamide, triallyl cyanurate, trimethylolpropanetriacrylate.

9. The process of claim 8 wherein the multifunctional monomer is trimethylolpropanetriacrylate.

10. The process of claim 1 wherein there is additionally present in the emulsion polymer up to 4 parts by weight of an alkenoic or alkenedioic acid having from 3 to 6 carbon atoms.

11. The process of claim 1 wherein the nonwoven mat is selected from the group consisting of polyester, felt, rayon or cellulose wood pulp.

12. The process of claim 11 wherein the nonwoven mat is polyester.

13. In a process for preparing a heat resistant nonwoven product comprising the steps of:

(a) impregnating a nonwoven web with an aqueous binder;

(b) removing excess binder; and (c) drying and curing the resultant mat; the improvement which comprises utilizing as the binder an emulsion polymer having a glass transition temperature (Tg) of +10° to +50° C., said polymer consisting essentially of 100 parts by weight of $C_1$ to $C_4$ acrylate or styrene/$C_2$ to $C_4$ acrylate monomers, 3 to 6 parts of a blocked, N-methylol containing comonomer selected from the group consisting of N-(iso-butoxymethyl) acrylamide, N-(iso-propoxymethyl) acrylamide, and N-(propoxymethyl) acrylamide; 0 to 3 parts of a water soluble non-blocked N-methylol containing comonomer; and 0 to 3 parts of a multifunctional comonomer.

* * * * *